US008894352B2

(12) United States Patent
Berrong et al.

(10) Patent No.: US 8,894,352 B2
(45) Date of Patent: Nov. 25, 2014

(54) RING SEGMENT WITH FORKED COOLING PASSAGES

(75) Inventors: Eric C. Berrong, Charlotte, NC (US); Ching-Pang Lee, Cincinnati, OH (US); Akash Bhatia, Charlotte, NC (US); Ryan S. Yamane, Gilbert, AZ (US); Stefan Tschirren, Laufen (CH); Leonard J. Meyer, Mesa, AZ (US)

(73) Assignee: Siemens Energy, Inc., Orlando, FL (US)

( * ) Notice: Subject to any disclaimer, the term of this patent is extended or adjusted under 35 U.S.C. 154(b) by 635 days.

(21) Appl. No.: 13/213,459

(22) Filed: Aug. 19, 2011

(65) Prior Publication Data

US 2012/0057960 A1 Mar. 8, 2012

Related U.S. Application Data

(60) Provisional application No. 61/380,450, filed on Sep. 7, 2010.

(51) Int. Cl.
*F01D 25/08* (2006.01)
*F01D 11/08* (2006.01)

(52) U.S. Cl.
CPC ..... *F01D 11/08* (2013.01); *F05D 2250/70* (2013.01); *F05D 2260/20* (2013.01)
USPC ..... 415/115; 415/173.1

(58) Field of Classification Search
USPC ..... 415/115, 116, 173.1; 416/96 R, 97 R, 416/97 A
See application file for complete search history.

(56) References Cited

U.S. PATENT DOCUMENTS

| | | | |
|---|---|---|---|
| 3,728,039 | A | 4/1973 | Plemmons et al. |
| 3,825,364 | A | 7/1974 | Halila et al. |
| 4,497,610 | A | 2/1985 | Richardson et al. |
| 4,573,865 | A | 3/1986 | Hsia et al. |
| 4,679,981 | A | 7/1987 | Guibert et al. |
| 4,752,184 | A | 6/1988 | Liang |
| 5,169,287 | A | 12/1992 | Proctor et al. |
| 5,374,161 | A | 12/1994 | Kelch et al. |
| 5,375,973 | A | 12/1994 | Sloop et al. |
| 5,380,150 | A | 1/1995 | Stahl |
| 5,486,090 | A | 1/1996 | Thompson et al. |
| 5,538,393 | A | 7/1996 | Thompson et al. |
| 6,155,778 | A | 12/2000 | Lee et al. |

(Continued)

FOREIGN PATENT DOCUMENTS

| | | | |
|---|---|---|---|
| EP | 0694677 | A1 | 1/1996 |
| EP | 1384855 | A2 | 1/2004 |
| FR | 2712629 | A1 | 5/1995 |
| JP | 11022411 | A | 1/1999 |

*Primary Examiner* — Dwayne J White

(57) ABSTRACT

A ring segment is provided for a gas turbine engine includes a panel and a cooling system. Cooling fluid is provided to an outer side of the panel and an inner side of the panel defines at least a portion of a hot gas flow path through the engine. The cooling system is located within that panel and receives cooling fluid from the outer side of the panel for cooling the panel. The cooling system includes a plurality of cooling fluid passages that receive cooling fluid from the outer side of the panel. The cooling fluid passages each have a generally axially extending portion that includes at least one fork. The fork(s) divide each cooling fluid passage into at least two downstream portions that each receives cooling fluid from the respective axially extending portion.

20 Claims, 4 Drawing Sheets

(56) References Cited

U.S. PATENT DOCUMENTS

| | | | |
|---|---|---|---|
| 7,033,138 | B2 | 4/2006 | Tomita et al. |
| 7,246,993 | B2 | 7/2007 | Bolms et al. |
| 7,284,954 | B2 | 10/2007 | Parker et al. |
| 7,665,962 | B1 | 2/2010 | Liang |
| 7,670,108 | B2 | 3/2010 | Liang |
| 2004/0146399 | A1 | 7/2004 | Bolms et al. |
| 2006/0182622 | A1 | 8/2006 | Parker et al. |
| 2010/0111671 | A1 * | 5/2010 | McGovern et al. ..... 415/115 |

* cited by examiner

RING SEGMENT WITH FORKED COOLING PASSAGES

CROSS REFERENCE TO RELATED APPLICATIONS

This application claims the benefit of U.S. Patent Application Ser. No. 61/380,450, filed Sep. 7, 2010, entitled "SERPENTINE COOLED RING SEGMENT," the entire disclosure of which is incorporated by reference herein.

FIELD OF THE INVENTION

The present invention relates to ring segments for gas turbine engines and, more particularly, to cooling of ring segments in gas turbine engines.

BACKGROUND OF THE INVENTION

It is known that the maximum power output of a combustion turbine is achieved by heating the gas flowing through the combustion section to as high a temperature as is feasible. The hot gas, however, heats the various turbine components, such as airfoils and ring segments, which it passes when flowing through the turbine section. One aspect limiting the ability to increase the combustion firing temperature is the ability of the turbine components to withstand increased temperatures. Consequently, various cooling methods have been developed to cool turbine hot parts. For example, ring segments, which provide an outer boundary for portions of the turbine section, may include cooling structure, such as internal cooling passages, that are formed in the ring segments to facilitate cooling thereof.

SUMMARY OF THE INVENTION

In accordance with a first aspect of the invention, a ring segment is provided for a gas turbine engine. The ring segment comprises a panel and a cooling system. The panel includes a leading edge, a trailing edge, a first mating edge, a second mating edge, an outer side, and an inner side. Cooling fluid is provided to the outer side and the inner side defines at least a portion of a hot gas flow path through the gas turbine engine. The cooling system is located within the panel and receives cooling fluid from the outer side of the panel for cooling the panel. The cooling system comprises a plurality of cooling fluid passages that receive cooling fluid from the outer side of the panel. The cooling fluid passages each comprise a generally axially extending portion that includes at least one fork. The fork(s) divide each cooling fluid passage into at least two downstream portions that each receive cooling fluid from the respective axially extending portion.

In accordance with a second aspect of the invention, a ring segment is provided for a gas turbine engine. The ring segment comprises a panel and a cooling system. The panel includes a leading edge, a trailing edge, a first mating edge, a second mating edge, an outer side, and an inner side. Cooling fluid is provided to the outer side and the inner side defines at least a portion of a hot gas flow path through the gas turbine engine. The cooling system is located within the panel and receives cooling fluid from the outer side of the panel for cooling the panel. The cooling system comprises a plurality of cooling fluid passages that receive cooling fluid from the outer side of the panel. The cooling fluid passages each comprise a supply portion, a generally axially extending portion, and at least one fork. The supply portion includes a transition section that extends generally axially toward the leading edge of the panel. The axially extending portion is located downstream from the supply portion with respect to a flow of cooling fluid through the cooling fluid passage. The axially extending portion is located circumferentially adjacent to the supply portion and extends generally axially toward the trailing edge of the panel. The fork(s) divide each cooling fluid passage into at least two downstream portions.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
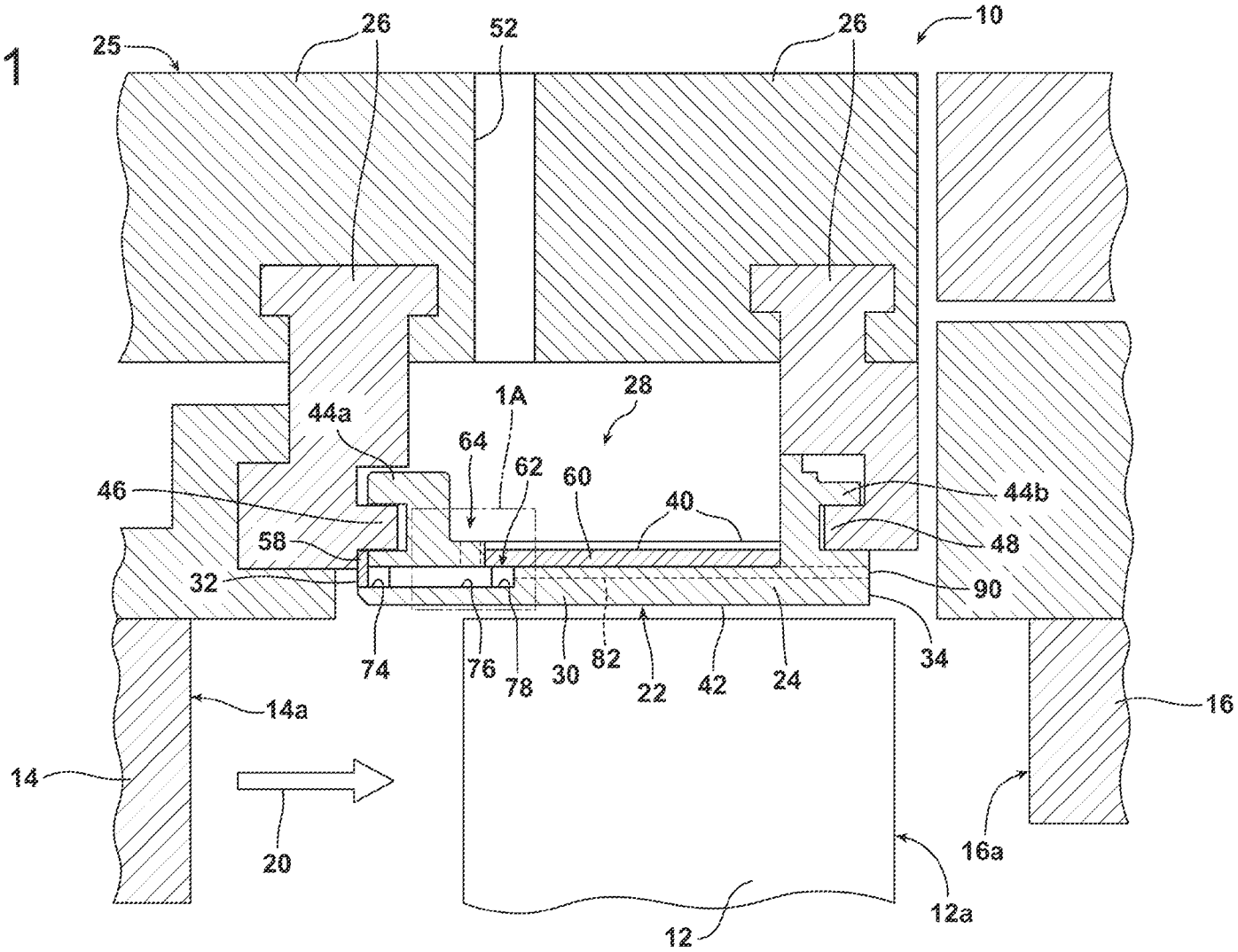
FIG. 1 is cross sectional view of a portion of a turbine section of a gas turbine engine, including a ring segment constructed in accordance with the present invention.

FIG. 1 illustrates a portion of a turbine section 10 of a gas turbine engine. Within the turbine section 10 are alternating rows of stationary vanes and rotating blades. In FIG. 1, a single blade 12 forming a row 12*a* of blades is illustrated. Also illustrated in FIG. 1 are part of an upstream vane 14 forming a row 14*a* of upstream vanes, and part of a downstream vane 16 forming a row 16*a* of downstream vanes. The blades 12 are coupled to a disc (not shown) of a rotor assembly. A hot working gas from a combustor (not shown) in the engine flows in a hot gas flow path 20 passing through the turbine section 10. The working gas expands through the turbine section 10 as it flows through the hot gas flow path 20 and causes the blades 12, and therefore the rotor assembly, to rotate.

In accordance with an aspect of the invention, an outer seal structure 22 is provided about and adjacent the row 12*a* of blades. The seal structure 22 comprises a plurality of ring segments 24, which, when positioned side by side in a circumferential direction of the engine, define the seal structure 22. The seal structure 22 has a ring shape so as to extend circumferentially about its corresponding row 12*a* of blades. A corresponding one of the seal structures 22 may be provided about each row of blades provided in the turbine section 10.

The seal structure 22 comprises an inner wall of a turbine housing 25 in which the rotating blade rows are provided and defines sealing structure for preventing or limiting the working gas from passing through the inner wall and reaching other structure of the turbine housing, such as a blade ring carrier 26 and an associated annular cooling fluid plenum 28. It is noted that the terms "inner", "outer", "radial", "axial", "circumferential", and the like, as used herein, are not intended to be limiting with regard to orientation of the elements recited for the present invention.

Figure 2:
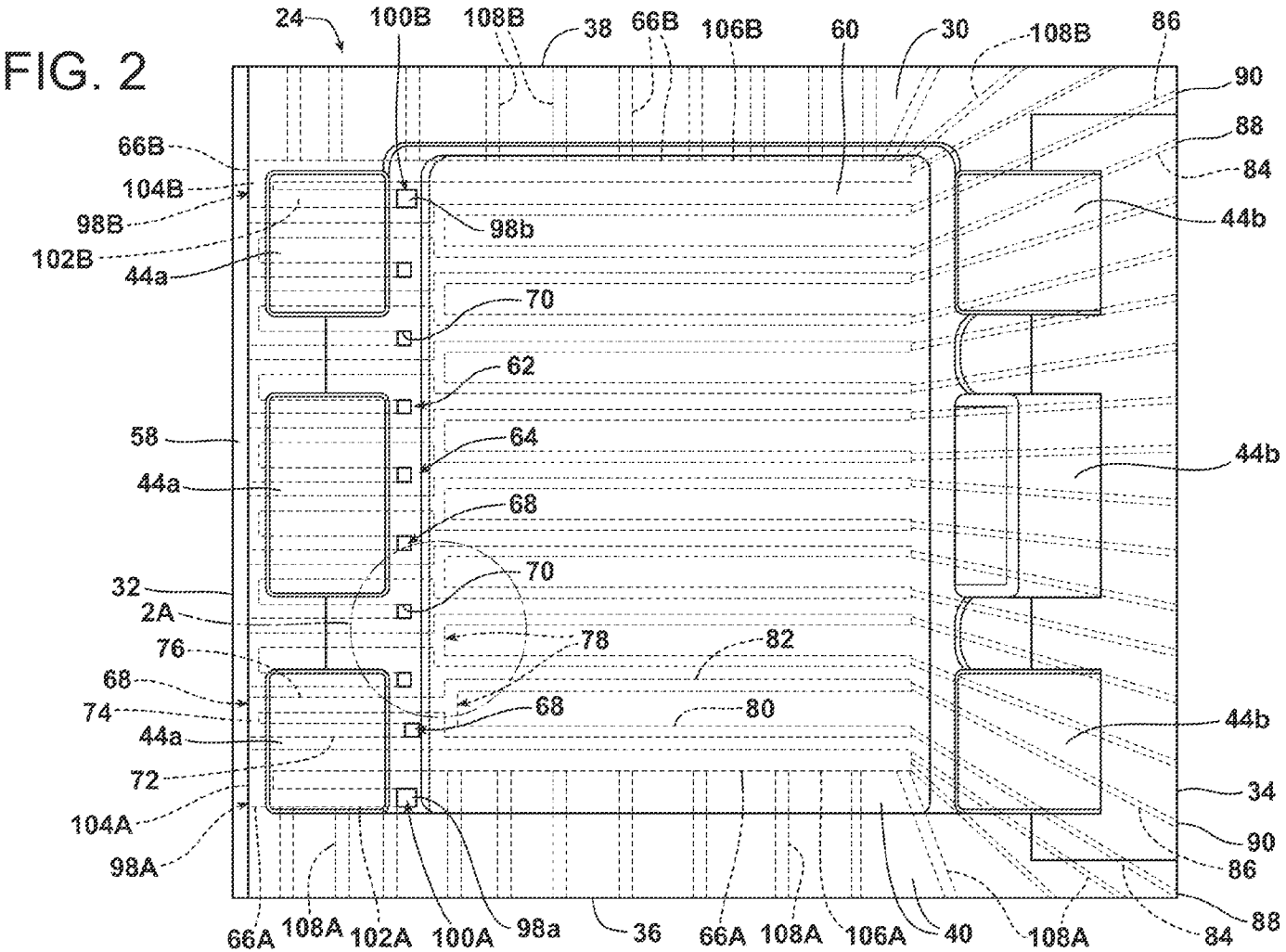
FIG. 2 is a top plan view of the ring segment illustrated in FIG. 1.

Referring to FIGS. 1 and 2, a single one of the ring segments 24 of the seal structure 22 is shown, it being understood that the other ring segments 24 of the seal structure 22 are generally identical to the single ring segment 24 shown and described. The ring segment 24 comprises a panel 30 including side edges comprising a leading edge 32, a trailing edge 34, a first mating edge 36 (see FIG. 2), and a second mating edge 38 (see FIG. 2). The panel 30 further includes an outer side 40 (see FIG. 1) and an inner side 42 (see FIG. 1), wherein the inner side 42 defines a corresponding portion of the hot gas flow path 20.

The panel 30 defines a structural body for the ring segment 24 and includes one or more front flanges or hook members 44*a* and one or more rear flanges or hook members 44*b*, see FIG. 1. The front and rear hook members 44*a*, 44*b* are rigidly attached to the panel 30, and may be formed with the panel 30 as an integral casting, or may be formed separately and subsequently rigidly attached to the panel 30. Moreover, if formed separately from the panel 30, the hook members 44*a*, 44*b* may be formed of the same material or a different material than the panel 30. Each ring segment 24 is mounted within the turbine section 10 via the front hook members 44*a* engaging a corresponding structure 46 of the blade ring carrier 26, and the rear hook members 44*b* engaging a corresponding structure 48 of the blade ring carrier 26, as shown in FIG. 1.

Referring to FIG. 1, the blade ring carrier 26 defines, in cooperation with the ring segment 24, the annular cooling fluid plenum 28, which defines a source of cooling fluid for the seal structure 22, as is described further below. The cooling fluid plenum 28 receives cooling fluid through a channel 52 formed in the blade ring carrier 26 from a source of cooling fluid, such as bleed air from a compressor (not shown) of the gas turbine engine.

As shown in FIGS. 1 and 2, the outer side 40 of the illustrated panel 30 may include a leading edge cover plate 58 and a mid section cover plate 60. The cover plates 58, 60 are used to enclose respective portions of a cooling system 62 provided within the panel 30, and may be secured to a remaining portion of the panel 30 using a suitable affixation procedure, such as, for example, by welding. It is noted that the cooling system 60 could be formed within and enclosed in the panel 30 by other means than the cover plates 58, 60, such that the cover plates 58, 60 are not considered to be a necessary aspect of the invention.

The cooling system 62 is located within the panel 30 and receives cooling fluid from the outer side 40 of the panel 30. Referring to FIG. 2, the cooling system 62 comprises cooling fluid passages 64 and first and second mating edge cooling fluid passageways 66A, 66B. The cooling fluid passages 64 and the mating edge cooling fluid passageways 66A, 66B each provide cooling to respective portions of the panel 30, as will be described herein. While eight cooling fluid passages 64 are illustrated in the panel 30 in the embodiment shown in FIG. 2, additional or fewer cooling fluid passages 64 may be provided in the panel 30.

A single one of the cooling fluid passages 64 will now be described, it being understood that the remaining cooling fluid passages 64 of the cooling system 62 are substantially similar to the cooling fluid passage 64 described.

As shown in FIGS. 1, 1A, 2, and 2A, the cooling fluid passage 64 comprises a supply portion 68 that receives cooling fluid from the outer side 40 of the panel 30. The supply portion 68 comprises an entrance section 70 that extends generally radially inwardly from the outer surface 40 of the panel 30 to a radial location in close proximity to the inner side 42 of the panel 30. The supply portion 68 further comprises a transition section 72 that extends generally axially from the entrance section 70 to a turnaround section 74 of the supply portion 68, see FIG. 2. The turnaround section 74 is located adjacent to the leading edge cover plate 58 at an axial location in close proximity to the leading edge 32 of the panel 30. The turnaround section 74 of the supply portion 68 is provided to effect a direction change, i.e., a generally 180 degree turnaround, for cooling fluid passing through the cooling fluid passage 64, such that the cooling fluid goes from flowing generally toward the leading edge 32 to flowing generally toward the trailing edge 34.

After changing direction at the turnaround section 74, the cooling fluid enters a generally axially extending portion 76 of the cooling fluid passage 64 located downstream from the supply portion 68 with respect to a flow of cooling fluid through the cooling fluid passage 64. The axially extending portion 76 of the cooling fluid passage 64 extends generally in the axial direction and is positioned circumferentially adjacent to the transition section 72 of the supply portion 68. The axially extending portion 76 extends from the turnaround section 74 to a fork 78, i.e., a split or partition, of the cooling fluid passage 64.

Figure 1A:
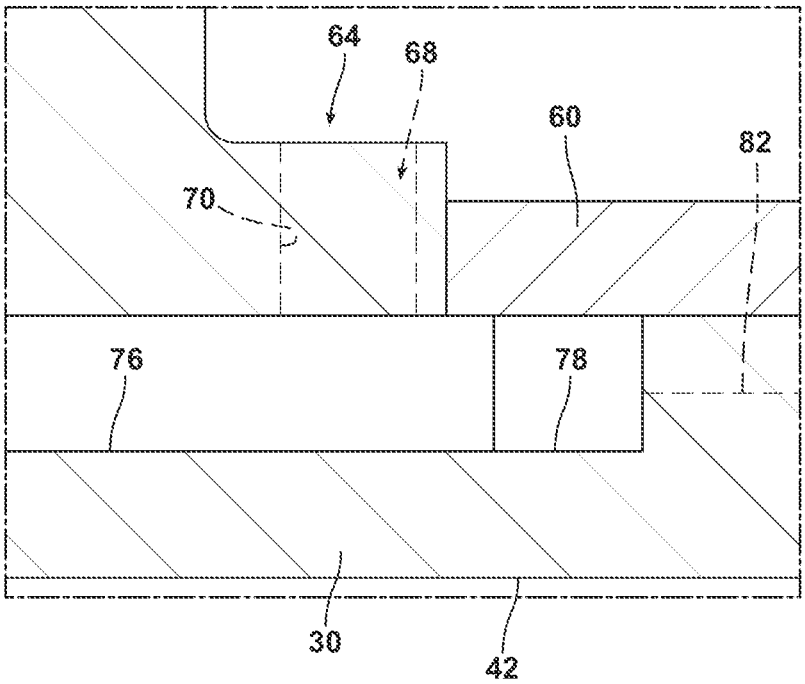
FIG. 1A is an enlarged cross sectional view of the portion of FIG. 1 identified by box 1A in FIG. 1.
Figure 2A:
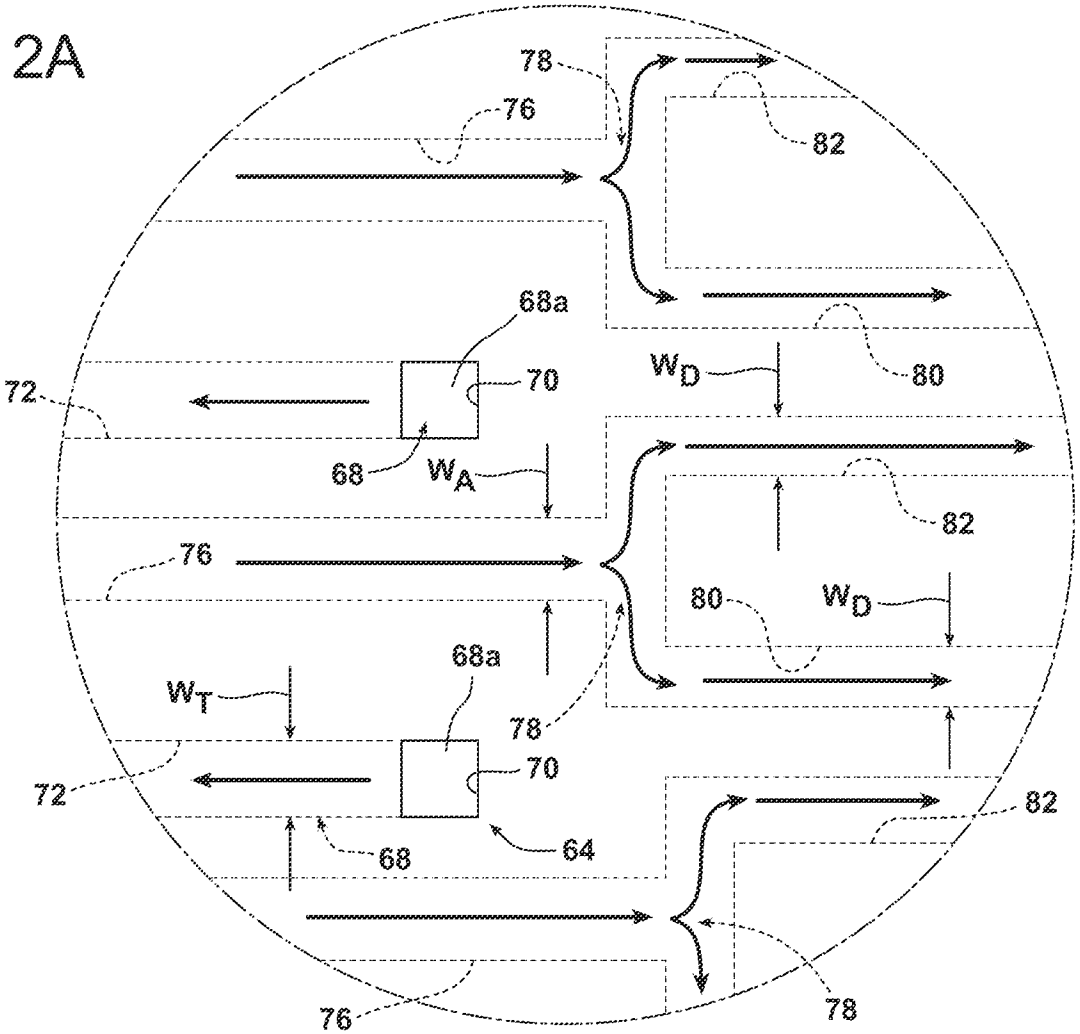
FIG. 2A is an enlarged top plan view of the portion of FIG. 2 identified by box 2A in FIG. 2.

As shown in FIGS. 1A, 2, and 2A, the fork 78 is located downstream from the axially extending portion 76 with respect to the flow of cooling fluid through the cooling fluid passage 64, and is located slightly axially rearward of the entrance section 70 of the supply portion 68. The fork 78 divides or splits the cooling fluid passage 64 into two downstream portions 80, 82. It is noted that, while the cooling fluid passage 64 is split into two downstream portions 80, 82 in the embodiment shown, the fork 78 may divide the cooling fluid passage 64 into more than two downstream portions if desired.

The downstream portions 80, 82 of the cooling fluid passage 64 extend from the fork 78 to respective discharge portions 84, 86 of the cooling fluid passage 64 at an axial location toward the trailing edge 34 of the panel 30, see FIG. 2. The discharge portions 84, 86 extend from the downstream portions 80, 82 to the trailing edge 34 of the panel 30 and include cooling fluid outlets 88, 90, which discharge cooling fluid from the cooling system 62 into the hot gas flow path 20, as will be described below.

While the dimensions of the various portions and sections of the cooling fluid passage 64 are configurable to effect a desired amount of cooling for the various areas of the panel 30, and while the invention is not intended to be limited to any specific passage dimensions, preferable dimensions for certain portions and/or sections of a specific embodiment of a cooling fluid passage 64 will now be described.

The transition section 72 of the supply portion 68 of the cooling fluid passage 64 preferably comprises a generally rectangular passage having a width $W_T$ (see FIG. 2A), i.e., measured in the circumferential direction, of from about 3.0 mm to about 4.0 mm, a height, i.e., measured in the radial direction, of from about 2.7 mm to about 3.8 mm, and a length, i.e., measured in the axial direction, of about 34.5 mm. The entrance section 70 of the supply portion 68 may have dimensions that correspond to the dimensions of the transition section 72.

The axially extending portion 76 of the cooling fluid passage 64 preferably comprises a generally rectangular passage having a width $W_A$ (see FIG. 2A), i.e., measured in the circumferential direction, of from about 3.0 mm to about 4.0 mm, a height, i.e., measured in the radial direction, of from about 2.3 mm to about 3.6 mm, and a length, i.e., measured in the axial direction, of about 36.6 mm. The length of the axially extending portion 76 is preferably slightly greater than the length of the transition section 72 of the supply portion 68 such that the fork 78 is located axially rearwardly, i.e., toward the trailing edge 34, from the entrance portion 70 of the supply portion 68. Such a configuration provides an efficient use of space within the panel 30, so as to increase the number of cooling fluid passages 64 that may be included in the panel 30, thus increasing cooling surface area and cooling and providing a generally even cooling fluid distribution to the panel 30 with respect to the circumferential direction.

The downstream portions 80, 82 of the cooling fluid passage 64 preferably comprise generally rectangular passages having widths $W_D$ (see FIG. 2A), i.e., measured in the circumferential direction, of from about 2.0 mm to about 3.0 mm, heights, i.e., measured in the radial direction, of from about 1.7 mm to about 2.6 mm, and lengths, i.e., measured in the axial direction, of about 62 mm. The downstream portions 80, 82 preferably comprise a smaller cross sectional area, i.e., equal to the width $W_D$ multiplied by the height of each downstream portion 80, 82, than a cross sectional area of the axially extending portion 76, i.e., equal to the width $W_A$ multiplied by the height of the axially extending portion 76. Such a cross sectional area reduction of the downstream portions 80, 82 results in a velocity increase for cooling fluid passing through the cooling fluid passage 64 with an associated improvement in cooling by the cooling fluid. It is noted that the cross sectional area reduction provides a parameter for controlling the flow speed of the cooling fluid and for controlling the heat transfer provided by the cooling fluid inside the cooling fluid passage 64.

The discharge portions 84, 86 of the cooling fluid passage 64 preferably comprise generally cylindrical passages having diameters of from about 1.2 to about 3.7 mm and lengths, i.e., measured in the axial direction, of about 34.5 mm. The cross sectional area reduction from the downstream portions 80, 82 to the discharge portions 84, 86 may be used to meter the flow rate of the cooling fluid passing through the cooling fluid passage 64.

Each of the portions 68, 76, 80, 82, 84, 86 of the cooling fluid passages 64 may be located in close proximity, e.g., about 2-3 mm, from the inner side 42 of the panel 30, such that adequate cooling to the inner side 42 of the panel 30 is provided by the cooling fluid passing through the cooling fluid passages 64.

As shown in FIG. 2, the first mating edge cooling fluid passageway 66A comprises a supply portion 98A that receives cooling fluid from the outer side 40 of the panel 30. The supply portion 98A comprises an entrance section 100A that extends generally radially inwardly from the outer surface 40 of the panel 30 to a radial location in close proximity to the inner side 42 of the panel 30. The supply portion 98A further comprises a transition section 102A that extends generally axially from the entrance section 100A to a turnaround section 104A of the supply portion 98A, see FIG. 2. The turnaround section 104A of the supply portion 98A is located adjacent to the leading edge cover plate 58 at an axial location in close proximity to the leading edge 32 of the panel 30. The turnaround section 104A of the supply portion 98A is provided to effect a direction change, i.e., a generally 180 degree turnaround, for cooling fluid passing through the first mating edge cooling fluid passageway 66A, such that the cooling fluid goes from flowing generally toward the leading edge 32 to flowing generally toward the trailing edge 34.

After changing direction at the turnaround section 104A, the cooling fluid enters a generally axially extending portion 106A of the first mating edge cooling fluid passageway 66A. The axially extending portion 106A of the first mating edge cooling fluid passageway 66A extends generally in the axial direction and is positioned circumferentially adjacent to the transition section 102A of the supply portion 98A. The axially extending portion 106A extends from the turnaround section 102A to an axial location generally corresponding to the axial location of the upstream side of the discharge portions 84, 86 of the cooling fluid passage 64, see FIG. 2. It is noted that the axially extending portion 106A of the first mating edge cooling fluid passageway 66A could extend to other axial locations as desired.

The first mating edge cooling fluid passageway 66A further comprises a plurality of branch portions 108A that extend toward a mating edge of an adjacent ring segment (not shown). The branch portions 108A of the first mating edge cooling fluid passageway 66A extend from both of the transition section 102A and the axially extending portion 106A of the mating edge cooling fluid passageway 66A.

As shown in FIG. 2, the second mating edge cooling fluid passageway 66B comprises a supply portion 98B that receives cooling fluid from the outer side 40 of the panel 30. The supply portion 98B comprises an entrance section 100B that extends generally radially inwardly from the outer surface 40 of the panel 30 to a radial location in close proximity to the inner side 42 of the panel 30. The supply portion 98B further comprises a transition section 102B that extends generally axially from the entrance section 100B to a turnaround section 104B of the supply portion 98B, see FIG. 2. The turnaround section 104B of the supply portion 98B is located adjacent to the leading edge cover plate 58 at an axial location in close proximity to the leading edge 32 of the panel 30. The turnaround section 104B of the supply portion 98B is provided to effect a direction change, i.e., a generally 180 degree turnaround, for cooling fluid passing through the second mating edge cooling fluid passageway 66B, such that the cooling fluid goes from flowing generally toward the leading edge 32 to flowing generally toward the trailing edge 34.

After changing direction at the turnaround section 104B, the cooling fluid enters a generally axially extending portion 106B of the second mating edge cooling fluid passageway 66B. The axially extending portion 106B of the second mating edge cooling fluid passageway 66B extends generally in the axial direction and is positioned circumferentially adjacent to the transition section 102B of the supply portion 98B. The axially extending portion 106B extends from the turnaround section 102B to an axial location generally corresponding to the axial location of the upstream side of the discharge portions 84, 86 of the cooling fluid passage 64, see FIG. 2. It is noted that the axially extending portion 106B of the second mating edge cooling fluid passageway 66B could extend to other axial locations as desired.

The second mating edge cooling fluid passageway 66B further comprises a plurality of branch portions 108B that extend toward a mating edge of an adjacent ring segment (not shown). The branch portions 108B of the second mating edge cooling fluid passageway 66B extend from the axially extending portion 106B of the second mating edge cooling fluid passageway 66B.

The dimensions of the mating edge cooling fluid passageways 66A, 66B are preferably slightly larger than the dimensions of the cooling fluid passages 64 described above. This is to ensure that adequate amounts of cooling fluid are provided into the mating edge cooling fluid passageways 66A, 66B.

The various portions of the passages and passageways described herein can be formed in the panel 30 using various manufacturing methods. For example, the entrance sections 70 and the transition sections 72 of the supply portions 68, the downstream portions 80, 82, the discharge portions 84, 86, and the mating edge cooling fluid passageways 66A, 66B can be formed in the panel 30 using an electro-discharge machining (EDM) operation. The axially extending portions 76 of the cooling fluid passages 64 can be either cast with the panel 30 or can be formed using a milling or EDM operation and then can be enclosed in the panel 30 using the mid section cover plate 60. Moreover, the turnaround sections 74 of the supply portions 68 can be formed in the panel 30 using a milling procedure and then can be enclosed in the panel 30 using the leading edge cover plate 58. While these exemplary methods for forming the various portions of the passages and passageways are described herein, other suitable methods may be used as desired.

During operation of the engine, cooling fluid is supplied to the cooling fluid plenum 28 via the channel 52 formed in the blade ring carrier 26. The cooling fluid in the cooling fluid plenum 28 flows to the outer side 40 of the panel 30 and is delivered into the cooling system 62.

Portions of the cooling fluid from the outer side 40 of the panel 30 flow into the cooling fluid passages 64 through the entrance sections 70 of the supply portions 68. The cooling fluid flowing in the supply portions 68 provides convective cooling to the panel 30. That is, the cooling fluid entering the supply portions 68 flows radially inwardly into the cooling fluid passages 64 and flows into walls 68*a* (see FIG. 2A) of the panel 30 located at junctions between the entrance sections 70 and the transition sections 72 of the supply portions 68. The cooling fluid provides convective cooling for the panel 30 while flowing within the sections 70, 72 of the supply portions 68.

The cooling fluid then provides convective cooling to the panel 30 as it flows within the axially extending portions 76 of the cooling fluid passages 64. Upon reaching the forks 78 within each cooling fluid passage 64, the cooling fluid is split or divided, wherein portions of the cooling fluid flow into each of the downstream portions 80, 82. The cooling fluid provides convective cooling to the panel 30 as it flows within the downstream portions 80, 82, and also provides convective cooling to the panel 30 as it flows within the discharge portions 84, 86. It is noted that, since the combined cross sectional area of the downstream portions 80, 82 is preferably smaller than the cross sectional areas of the axially extending portions 76, the velocity of the cooling fluid is increased as the cooling fluid enters and flows through the downstream portions 80, 82. This velocity increase effects an increase in cooling provided to the portion of the panel 30 associated with the downstream portions 80, 82.

The cooling fluid in the cooling fluid passages 64 provides cooling to the panel 30 of each ring segment 24 as discussed above and is then discharged into the hot gas path 20 by the cooling fluid discharge portions 84, 86 through the cooling fluid outlets 88, 90. It is noted that since the cooling fluid passages 64 are not connected with one another, the cooling fluid flowing through each cooling fluid passage 64 does not mix with the cooling fluid flowing through others of the cooling fluid passages 64 once the cooling fluid enters the respective cooling fluid passage 64. Hence, a generally uniform amount of cooling is believed to be provided to the panel 30 from the cooling fluid flowing within each cooling fluid passage 64.

Portions of the cooling fluid from the outer side 40 of the panel 30 also flow into the mating edge cooling fluid passageways 66A, 66B through the entrance sections 100A, 100B of the supply portions 98A, 98B. The cooling fluid flowing in the supply portions 98A, 98B provides convective cooling to the panel 30. That is, the cooling fluid entering the supply portions 98A, 98B flows radially inwardly into the mating edge cooling fluid passageways 66A, 66B and flows into walls 98*a*, 98*b* (see FIG. 2) of the panel 30 located at junctions between the entrance sections 100A, 100B and the transition sections 102A, 102B of the supply portions 98A, 98B. The cooling fluid provides convective cooling for the panel 30 while flowing within the sections 100A, 100B, 102A, 102B, 104A, 104B of the supply portions 98A, 98B.

The cooling fluid also provides cooling to the panel 30 as it flows within the axially extending portions 106A, 106B of the mating edge cooling fluid passageways 66A, 66B. Additionally, the cooling fluid provides convective cooling to the panel 30 while flowing through the branch portions 108A, 108B of the mating edge cooling fluid passageways 66A, 66B, and provides impingement cooling to the mating edges of the adjacent ring segments (not shown) upon being discharged from the cooling system 62 from the branch portions 108A, 108B of the mating edge cooling fluid passageways 66A, 66B. Moreover, the cooling fluid discharged from the branch portions 108A, 108B may provide a curtain or wall of air in gaps between adjacent ring segments for limiting/preventing leakage of hot working gas into the gaps.

It is believed that the present configuration for the ring segments 24 provides an efficient cooling of the panels 30 via the impingement and convective cooling provided by the cooling fluid passing through the respective cooling systems 62. Such efficient cooling of the ring segments 24 is believed to result in a lower cooling fluid requirement than prior art ring segments. Hence, enhanced cooling may be provided within the ring segments 24 while minimizing the volume of cooling fluid discharged from the ring segments 24 into the hot working gas, thus resulting in an associated improvement in engine efficiency, i.e., since a lesser amount of cooling fluid is mixed into the hot gas path 20, aerodynamic mixing losses of the hot working gas are reduced. Further, the distributed cooling provided to the panels 30 with the cooling systems 62 is believed to improve the uniformity of temperature distribution across the ring segments 24, i.e., a reduction in a temperature gradient throughout the panel 30, and reduction in thermal stress, resulting in an improved or extended life of the ring segments 24.

Additionally, since all the cooling fluid provided into the cooling systems 62 enters near the leading edge 32 of the panel 30, adequate cooling is provided to the leading edge 32 of the panel 32. Moreover, since all of the cooling fluid that is provided into the cooling fluid passages 64 exits the panel 30 at the trailing edge 34, a large pressure drop is effected, which drives the cooling fluid through the cooling fluid passages 64. The large pressure drop also allows for smaller passages and higher cooling fluid velocities, which provide improved cooling of the panel 30 by the cooling fluid.

A further advantage may be realized by providing passages having a rectangular configuration, in that a greater area of the passage may be located at a surface of the panel 30 adjacent to the inner side 42 of the ring segment 24, which is associated with the hot gas flow path 20. Hence, a larger surface area for convective heat transfer is provided for facilitating cooling of the surface of the panel 30 adjacent to the inner side 42 of the ring segment 24.

It is noted that the cooling system 62 described herein is not intended to be limited to being implemented in the specific ring segment 24 illustrated herein, i.e., the cooling system 62 could be implemented in any type of ring segment in a turbine engine.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A ring segment for a gas turbine engine comprising:

a panel having a leading edge, a trailing edge, a first mating edge, a second mating edge, an outer side, and an inner side, wherein cooling fluid is provided to the outer side and the inner side defines at least a portion of a hot gas flow path through the gas turbine engine, and wherein an axial direction is defined between the leading and trailing edges and a radial direction is defined between the outer and inner sides; and a cooling system within the panel that receives cooling fluid from the outer side of the panel for cooling the panel, the cooling system comprising:

a plurality of cooling fluid passages that receive cooling fluid from the outer side of the panel, the cooling fluid passages each comprising a generally axially extending portion extending through the panel in the axial direction and including at least one fork, the at least one fork dividing each cooling fluid passage into at least two downstream portions that each receive cooling fluid from the respective axially extending portion.

2. The ring segment according to claim 1, wherein the axial extending portions of the cooling passages are upstream from the downstream portions with respect to the axial direction, and wherein cooling fluid flowing through the axial extending portions and the downstream portions flows in a direction toward the trailing edge of the panel.

3. The ring segment according to claim 1, wherein the cooling fluid passages further comprise supply portions that receive cooling fluid from the outer side of the panel, the supply portions including entrance sections that extend generally radially from the outer side of the panel to near the inner side of the panel.

4. The ring segment according to claim 3, wherein the supply portions further comprise:

transition sections that extend generally axially toward the leading edge of the panel from the entrance sections to near the leading edge of the panel; and turnaround sections in fluid communication with the transition sections that change the direction of the cooling fluid passing through the cooling fluid passages from toward the leading edge of the panel to toward the trailing edge of the panel, the turnaround sections delivering the cooling fluid from the supply portions to the axially extending portions.

5. The ring segment according to claim 4, wherein the axially extending portion and the transition section of each cooling fluid passage are circumferentially adjacent to one another.

6. The ring segment according to claim 5, wherein substantially all of the cooling fluid that is provided into the cooling system flows adjacent to the leading edge of the panel.

7. The ring segment according to claim 1, wherein the cooling fluid passages further comprise discharge portions extending from the downstream portions to the trailing edge of the panel, wherein the discharge portions discharge the cooling fluid from the cooling system into the hot gas flow path.

8. The ring segment according to claim 7, wherein at least some of the discharge portions are angled toward at least one of the mating edges of the panel.

9. The ring segment according to claim 1, wherein the downstream portions of the cooling fluid passages define a smaller cross sectional area than the axially extending portions.

10. The ring segment according to claim 1, wherein lengths of the downstream portions of the cooling fluid passages are at least about two times greater than lengths of the axially extending portions.

11. The ring segment according to claim 1, wherein the cooling fluid in each cooling fluid passage does not mix with cooling fluid from other ones of the cooling fluid passages once the cooling fluid enters the cooling fluid passages.

12. The ring segment according to claim 1, further comprising at least one mating edge cooling fluid passageway that receives cooling fluid from the outer side of panel and delivers cooling fluid to a respective first or second mating edge of the panel.

13. The ring segment according to claim 12, wherein each mating edge cooling fluid passageway comprises a supply portion that receives cooling fluid from the outer side of the panel.

14. The ring segment according to claim 13, wherein each mating edge cooling fluid passageway further comprises a plurality of branch portions that deliver cooling fluid from the mating edge cooling fluid passageway to a respective mating edge.

15. A ring segment for a gas turbine engine comprising:

a panel having a leading edge, a trailing edge, a first mating edge, a second mating edge, an outer side, and an inner side, wherein cooling fluid is provided to the outer side and the inner side defines at least a portion of a hot gas flow path through the gas turbine engine, and wherein an axial direction is defined between the leading and trailing edges and a radial direction is defined between the outer and inner sides; and a cooling system within the panel that receives cooling fluid from the outer side of the panel for cooling the panel, the cooling system comprising a plurality of cooling fluid passages that receive cooling fluid from the outer side of the panel, the cooling fluid passages each comprising:

a supply portion including a transition section that extends generally axially toward the leading edge of the panel;

a generally axially extending portion located downstream from the supply portion with respect to a flow of cooling fluid through the cooling fluid passage, the axially extending portion located circumferentially adjacent to the supply portion and extending generally axially toward the trailing edge of the panel generally parallel to the transition section; and at least one fork downstream from the axially extending portion with respect to the flow of cooling fluid through the cooling fluid passage, the at least one fork dividing each cooling fluid passage into at least two downstream portions.

16. The ring segment according to claim 15, wherein the axially extending portion has a length in an axial direction that is greater than a length of the transition section in the axial direction.

17. The ring segment according to claim 16, wherein the supply portion further comprises an entrance section that extends generally radially from the outer side of the panel to the transition section.

18. The ring segment according to claim 16, wherein the fork is located axially rearwardly from the entrance section of the supply portion.

19. The ring segment according to claim 16, wherein the downstream portions of the cooling fluid passage comprise a smaller cross sectional area than the axially extending portion.

20. The ring segment according to claim 16, wherein cooling fluid flowing through the axial extending portion and the downstream portions of each cooling fluid passage flows in a direction toward the trailing edge of the panel.

* * * * *